US005906291A

United States Patent [19]

Mann et al.

[11] Patent Number: 5,906,291

[45] Date of Patent: May 25, 1999

[54] STORAGE CONTAINER

[75] Inventors: David G. Mann, Wooster, Ohio; Charles E. Wagner, Mulvane, Kans.; Matthew P. Williams, N. Canton, Ohio

[73] Assignee: Rubbermaid Specialty Products Inc., Wooster, Ohio

[21] Appl. No.: 08/776,730

[22] PCT Filed: Jun. 6, 1996

[86] PCT No.: PCT/US96/09884

§ 371 Date: Mar. 30, 1997

§ 102(e) Date: Mar. 30, 1997

[87] PCT Pub. No.: WO96/40567

PCT Pub. Date: Dec. 19, 1996

Related U.S. Application Data

[63] Continuation-in-part of application No. 08/483,383, Jun. 7, 1995, Pat. No. 5,718,350.

[51] Int. Cl.[6] ..... B65D 85/00

[52] U.S. Cl. ..... 220/756; 220/757; 190/39; 16/112

[58] Field of Search ..... 220/755, 756, 220/757; 16/112; 190/39

[56] References Cited

U.S. PATENT DOCUMENTS

| | | | |
|---|---|---|---|
| D. 345,650 | 4/1994 | Boyd | D12/423 |
| 429,510 | 6/1890 | Davy et al. . | |
| 479,936 | 8/1892 | Foster . | |
| 643,492 | 2/1900 | Fromholz | 220/757 |
| 740,732 | 10/1903 | Beehler . | |
| 968,222 | 8/1910 | Williams . | |
| 2,342,477 | 2/1944 | Magnenat | 220/31 |
| 2,611,479 | 9/1952 | Oliver | 206/16 |
| 2,732,581 | 1/1956 | Heck | 16/171 |
| 2,797,840 | 7/1957 | Gibbs | 220/31 |
| 3,126,120 | 3/1964 | Crate | 220/31 |
| 3,259,230 | 7/1966 | Jaeger | 206/16 |
| 3,713,681 | 1/1973 | Worley | 292/78 |

(List continued on next page.)

FOREIGN PATENT DOCUMENTS

| | | | |
|---|---|---|---|
| 2 128 245 | 4/1984 | United Kingdom | E05D 7/10 |

OTHER PUBLICATIONS

Rubbermaid advertisement ActionPacker Storage Containers, 1 page (1992).

Rubbermaid advertisement "Automotive Products", 3 pages (1993).

*Primary Examiner*—Joseph M. Moy

*Attorney, Agent, or Firm*—Renner, Kenner, Greive, Bobak, Taylor & Weber

[57] ABSTRACT

A container (20) includes a base portion (21) having a bottom surface (23), front (24) and rear (25) walls extending upwardly from the bottom surface (23), and opposed side walls (26) extending upwardly from the bottom surface (23) and, together with the front (24) and rear (25) walls, defining an open top. A cover (22) is provided to close the open top and may be selectively attached to the rear wall (25) by hinge assemblies (50) and to the front wall (24) by a latch mechanism (60). A side handle (85) is positioned in a recess (81) formed in each side wall (26) and may be pivoted from a position in the recesses (81) to the carrying position outside the recesses (81). Alternatively, a side handle assembly (101) is positioned in a recess (112) formed in a side wall (107) and wheels (111) can be located adjacent to the other side wall (108). The handle assembly (101) may be pivoted outside the recess (112) and its handle member (115) telescoped relative to the handle assembly (101) to extend the length thereof. A track (37) on the upper surface (35) of the cover (22) may be received within a platform (43) on the lower surface (36) of the cover (22) of a like container (20) to stack the same. Similarly, a chamfer (28) is formed near the periphery of the bottom surface (23) of base portion (21) and can be received within the track (37) of the cover (22) of a like container (20) to stack the same.

12 Claims, 18 Drawing Sheets

U.S. PATENT DOCUMENTS

| | | | |
|---|---|---|---|
| 3,791,547 | 2/1974 | Branscum | 220/17 |
| 3,979,011 | 9/1976 | Schleicher | 220/757 |
| 4,114,759 | 9/1978 | Maloney, Jr. | 206/523 |
| 4,249,760 | 2/1981 | Conley | 292/197 |
| 4,331,257 | 5/1982 | Taschner | 220/324 |
| 4,349,120 | 9/1982 | DiNardo | 220/337 |
| 4,372,007 | 2/1983 | Lee | 16/260 |
| 4,449,629 | 5/1984 | Barrieau | 206/45.19 |
| 4,502,715 | 3/1985 | Lundblade | 292/78 |
| 4,522,312 | 6/1985 | Rathgeber et al. | 220/324 |
| 4,585,134 | 4/1986 | Miyaji et al. | 220/757 |
| 4,696,412 | 9/1987 | McGowan et al. | 220/335 |
| 4,775,072 | 10/1988 | Lundblade et al. | 220/94 R |
| 4,844,263 | 7/1989 | Hadtke | 206/508 |
| 4,846,493 | 7/1989 | Mason | 280/641 |
| 4,879,889 | 11/1989 | DeForrest, Sr. | 70/56 |
| 4,942,271 | 7/1990 | Corsi et al. | 174/101 |
| 5,002,199 | 3/1991 | Frahm | 220/670 |
| 5,011,013 | 4/1991 | Meisner et al. | 206/373 |
| 5,040,834 | 8/1991 | Kahl et al. | 292/204 |
| 5,048,715 | 9/1991 | Wolff | 220/335 |
| 5,078,297 | 1/1992 | Howard et al. | 220/553 |
| 5,259,215 | 11/1993 | Rocca | 62/371 |
| 5,310,079 | 5/1994 | Sandy et al. | 220/755 |
| 5,511,682 | 4/1996 | Pace | 220/757 |

STORAGE CONTAINER

CROSS-REFERENCE TO RELATED APPLICATION

This application is a continuation-in-part of U.S. patent application Ser. No. 08/483,383 which was filed Jun. 7, 1995, now U.S. Pat. No. 5,718,350.

TECHNICAL FIELD

This invention relates to plastic storage containers. More particularly, this invention relates to such containers which have a cover which may have one side latchable to the base portion thereof and may have its other side pivotally attached to the base in a manner by which the cover may be readily removed from the base. More specifically, this invention relates to such containers which are also portable and have at least one pivotable and recessable side handle. The containers themselves or just the covers thereof may be stacked for ease of shipment, storage and retail display.

BACKGROUND ART

All-purpose, portable, plastic storage containers, tool boxes, ice chests and the like, which have a base container with an open top and a cover for closing the open top, are well-known in the art. In some such containers, the cover merely rests on the lip of the base and, in some instances, can be snapped over the periphery of the lip of the base. In other instances, one edge of the cover is permanently hingedly attached to one upper edge of the base, with the opposite edge of the cover either merely resting on, or being latched and possibly locked to, the opposed edge of the base.

In still other versions of storage containers, opposed sides of the cover may merely be latched to the base and, when unlatched, the cover may be completely removed. Such a container is shown, for example, in U.S. Pat. No. 5,125,697. The container of that patent is unique in that it provides opposed latches which can be locked with a padlock to hold the cover on the base. Its drawbacks, however, are that it takes two padlocks to completely secure the contents of the container and there is no provision for any hinged attachment resulting in the fact that, once unlatched, the only option available to the user is to totally remove the cover. Moreover, the latch of this patent can be difficult to assemble.

Most portable storage containers are rendered portable by, for example, a handle recessable in its cover. Such is shown in U.S. Pat. No. 5,193,706. The container of that patent, as well as others, can also be carried by grasping each end of the container at an area where the top overhangs the side walls. The container of the '697 patent can likewise be gripped at the sides by grasping the undersides of the latch mechanisms. Such side-gripping is most desirable for containers that are large enough to carry heavy items which would thus warrant two-handed lifting and carrying. Ideally, such handles would be easily assembled, recessed in the sides, and lockable in a carrying position but, to date, no one has designed such handles for these types of containers.

Other storage containers are rendered portable by providing the base thereof with one or more sets of wheels. Where one set of wheels is employed at one end of the container, usually some type of lifting handle must be utilized at the other end of the container so that such end of the container can be lifted and the container then moved on its wheels. At the present time, however, no such container has been designed so that the handle can be recessed in that other end of the container, readily assembled therein, and yet be of a sufficient length to enable the user to lift and move the container.

In addition, for storage, shipping and retail display purposes, it is desirable that the containers with their covers in place, and even the covers themselves, be readily, securely and safely stackable with each other. While some efforts have been made to make similar containers nestable, and their covers stackable, to-date it is not believed that any container/cover design is such that covers can be securely stacked on each other and entire containers can be securely stacked on each other.

DISCLOSURE OF THE INVENTION

It is thus an object of the present invention to provide a storage container which is economically assembled, easy to manufacture and convenient to use.

It is another object of the present invention to provide a storage container, as above, in which one edge of the cover is provided with a hinge-like engagement with the base and yet is readily removable from the base.

It is a further object of the present invention to provide a storage container, as above, in which the opposed edge of the cover can be conveniently latched and locked to the base of the container by an easily assembled and operated latch mechanism.

It is an additional object of the present invention to provide a storage container, as above, which is provided with recessed side handles which are easy to install and which are pivotal to a locked, upright position.

It is yet another object of the present invention to provide a storage container, as above, in which the bottom thereof is configured to securely stack on the top of a specially configured cover of a like container.

It is still another object of the present invention to provide a storage container, as above, in which the bottom of the cover is especially configured to securely stack on the top of the cover of a like container.

It is a still further object of the present invention to provide a storage container, as above, which is alternatively provided with a set of wheels at one end thereof and which has a handle recessed in the other end thereof.

It is an even further object of the present invention to provide a storage container, as above, in which the recessed handle is easily assembled in the end of the container, to be pivotal therein, and at the same time having a grip portion which can be telescopically extended.

These and other objects of the present invention, as well as the advantages thereof over existing prior art forms, which will become apparent from the description to follow, are accomplished by the improvements hereinafter described and claimed.

In general, a container may, in accordance with one aspect of the present invention, include a base portion having a bottom surface and opposed front and rear walls, and opposed side walls extending upwardly from the bottom surface to form an open top. A cover is provided to selectively close the open top. At least one hinge assembly selectively connects one edge of the cover to the top of the rear wall. The hinge assembly includes a socket formed in the edge of the cover which receives a ledge and opposed flange formed at the top of the rear wall in such a fashion that the cover can be pivoted on the ledge and flange.

In accordance with another aspect of the invention, a latch assembly may be provided to connect the opposed edge of the cover to the front wall of the container. A pocket is formed near the top of the front wall to receive a latch block. A flexible tongue extends generally from the latch block and a tab is formed on the edge of the cover. There is an aperture in the tab such that the tongue may be received through the aperture to engage the tab.

An additional concept of the present invention relates to handle assemblies which include handles pivotally mounted in recesses in one set of the opposed walls. A lug is formed on a wall in the recesses and, as the handles are pivoted from a first position in the recesses to a second position outside the recess, the handle moves over the lug and the lug then maintains the handle in the second position.

As an alternative to the handle assemblies just described, at least one wall of one of the sets of opposed walls may be provided with a handle assembly-receiving recess. That recess has opposed pivot apertures formed therein. The handle assembly includes a first plate having a pivot pin receivable in one of the pivot apertures and a second plate having a pivot pin receivable in the other of the pivot apertures. A handle arm is slidably supported between the plates so that after the handle assembly has been pivoted out of its recess, the handle arm can move relative to the plates.

The containers and/or their covers can be stacked on each other in a secure fashion. To that end, a track is formed on the upper surface of the cover and a platform is formed on the lower surface of the cover. The track may be received within the platform of the cover of a like container so that like covers may be stacked. A chamfer is formed at the periphery of the bottom surface of the base portion and may be received within the track of the cover of a like container so that the containers may be stacked.

A preferred exemplary storage container, incorporating the concepts of the present invention, is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
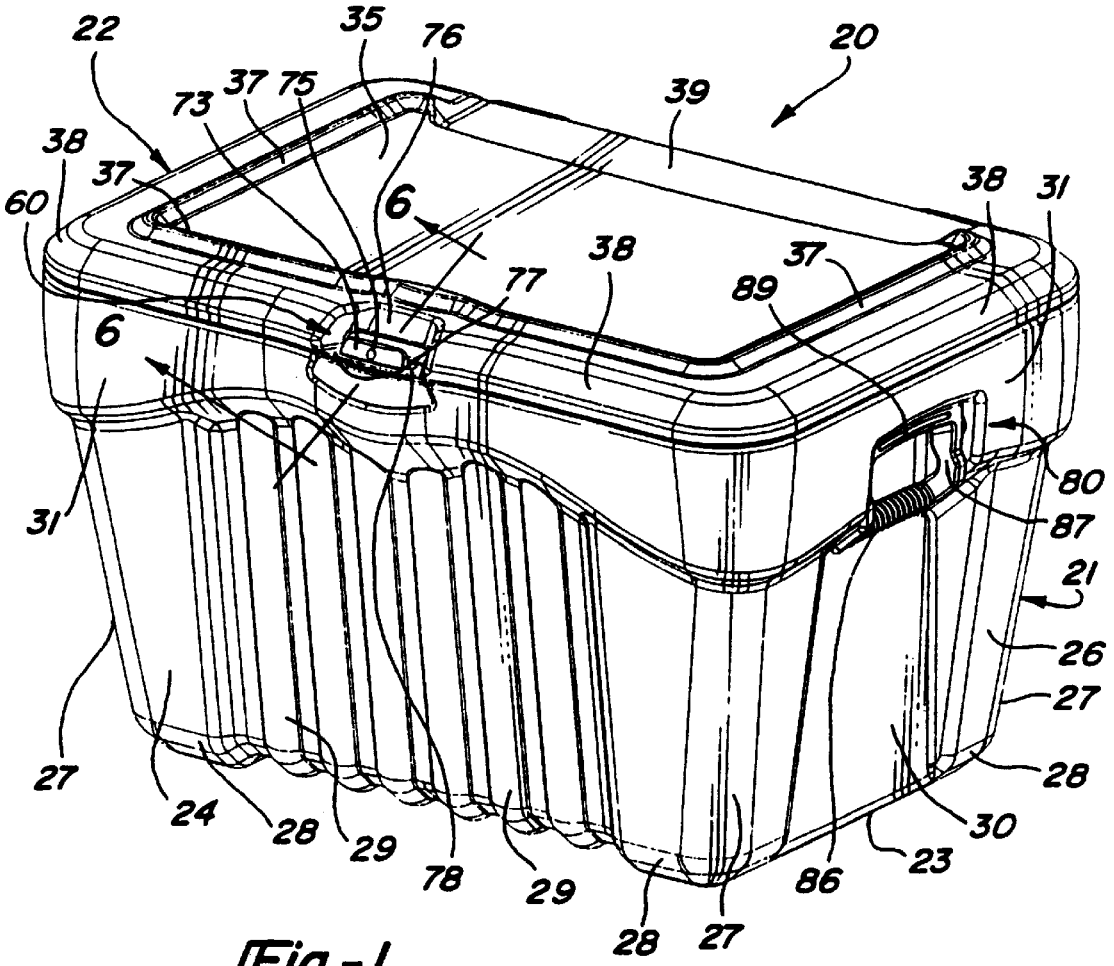
FIG. 1 is a perspective view of a storage container made in accordance with the concepts of the present invention and showing the front, top and one side thereof.
Figure 2:
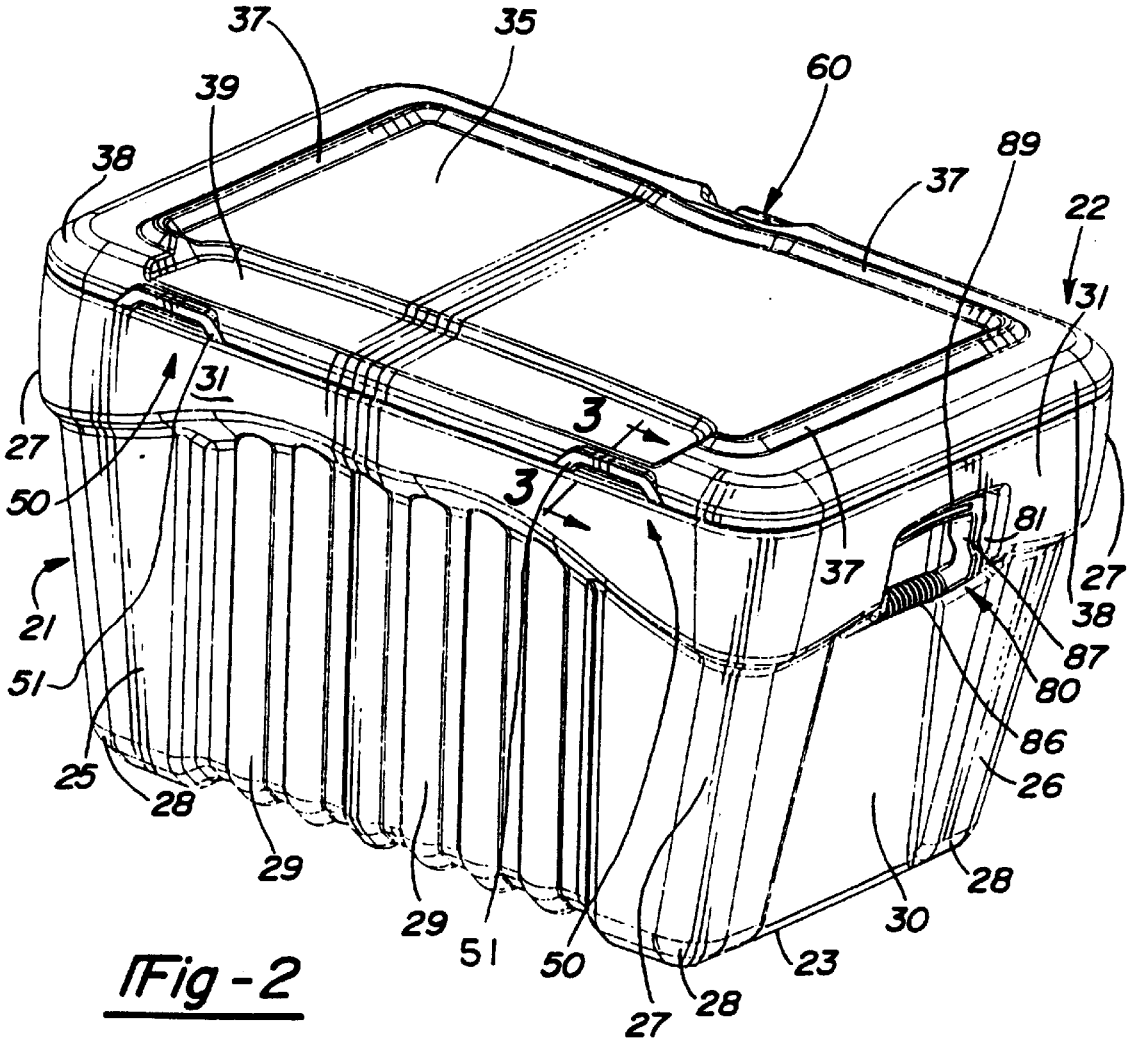
FIG. 2 is another perspective view of the storage container shown in FIG. 1 and showing the rear, top and other side thereof.

A storage container made in accordance with the concepts of the present invention is shown in FIGS. 1 and 2 and indicated generally by the numeral 20. Storage container 20 includes a base container portion, generally indicated by the numeral 21, and a cover generally indicated by the numeral 22. Both base portion 21 and cover 22 are preferably made of a polyolefin plastic material.

Base portion 21 includes a bottom surface 23 having a generally vertical front wall 24 and opposed rear wall 25 extending upwardly therefrom. Opposed and generally identical side walls 26 also extend generally vertically upwardly from bottom surface 23. Side walls 26 join with the front wall 24 and rear wall 25 at radiused corners 27 to form the base container portion 21 with an open top that is selectively closed by cover 22. A chamfer 28 extends around the periphery of base portion 21, near the bottom of walls 24, 25 and 26, and just above bottom surface 23, so that, as will hereinafter be described, base container 21 may securely stack onto the cover 22 of a like container 20.

Front wall 24 and rear wall 25 are provided, generally centrally thereof, with ribs 29 which primarily function to add strength to those walls of base portions 21. In addition, side walls 26 are each provided with a centrally located recess 30 which tapers outwardly, that is, it widens from top to bottom. The entire upper periphery of base portion 21, that is, the top of each wall 24, 25 and 26, is provided with an enlarged sculptured collar 31. As shown, for example, in FIG. 3, a generally horizontal ledge 32 is formed at the top of collar 31. An upwardly-directed lip 33 is provided at the inner periphery of ledge 32. A small, horizontal hook-like rim flange 34 is formed at the top of lip 33 and is thus opposed to ledge 32.

Figure 12:
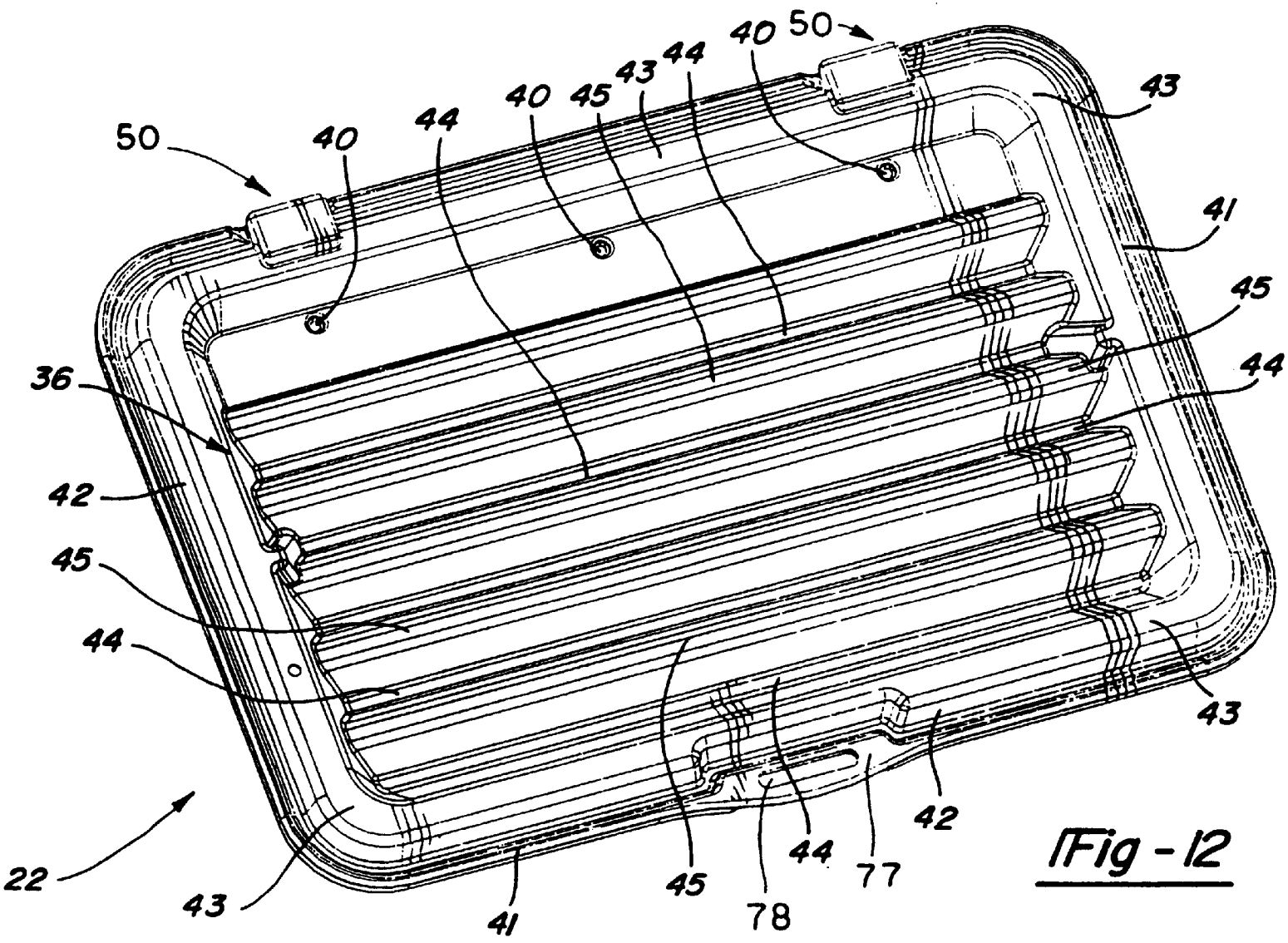
FIG. 12 is a perspective view showing the bottom of the cover of the container of FIG. 1.

Cover 22 is preferably a double-walled structure having a primarily planar upper surface 35 and an irregularly-configured lower surface indicated generally by the numeral 36 and best shown in FIG. 12. Upper surface 35 includes a raised track area 37. Among other things, track area 37 serves to locate chamfer 28 of base portion 21 such that when base portion 21 of a like container is positioned on top of cover 22, chamfer 28 will be received within track 37. Thus, track 37 serves to locate the base portion positioned above and keeps it from sliding off of cover 22.

The outer periphery of upper surface 35 is provided with an arcuate, downwardly-directed skirt 38 which, as will hereinafter be described in more detail, generally matches the contour of, and otherwise compliments collar 31 of base portion 21. Skirt 38 is interrupted near the back thereof by a planar surface 39 which is stepped downward from surface 35. Surface 39 is joined to lower surface 36 at a plurality of tackoff points 40 (FIGS. 3 and 12) to add structural strength to cover 22.

Figure 13:
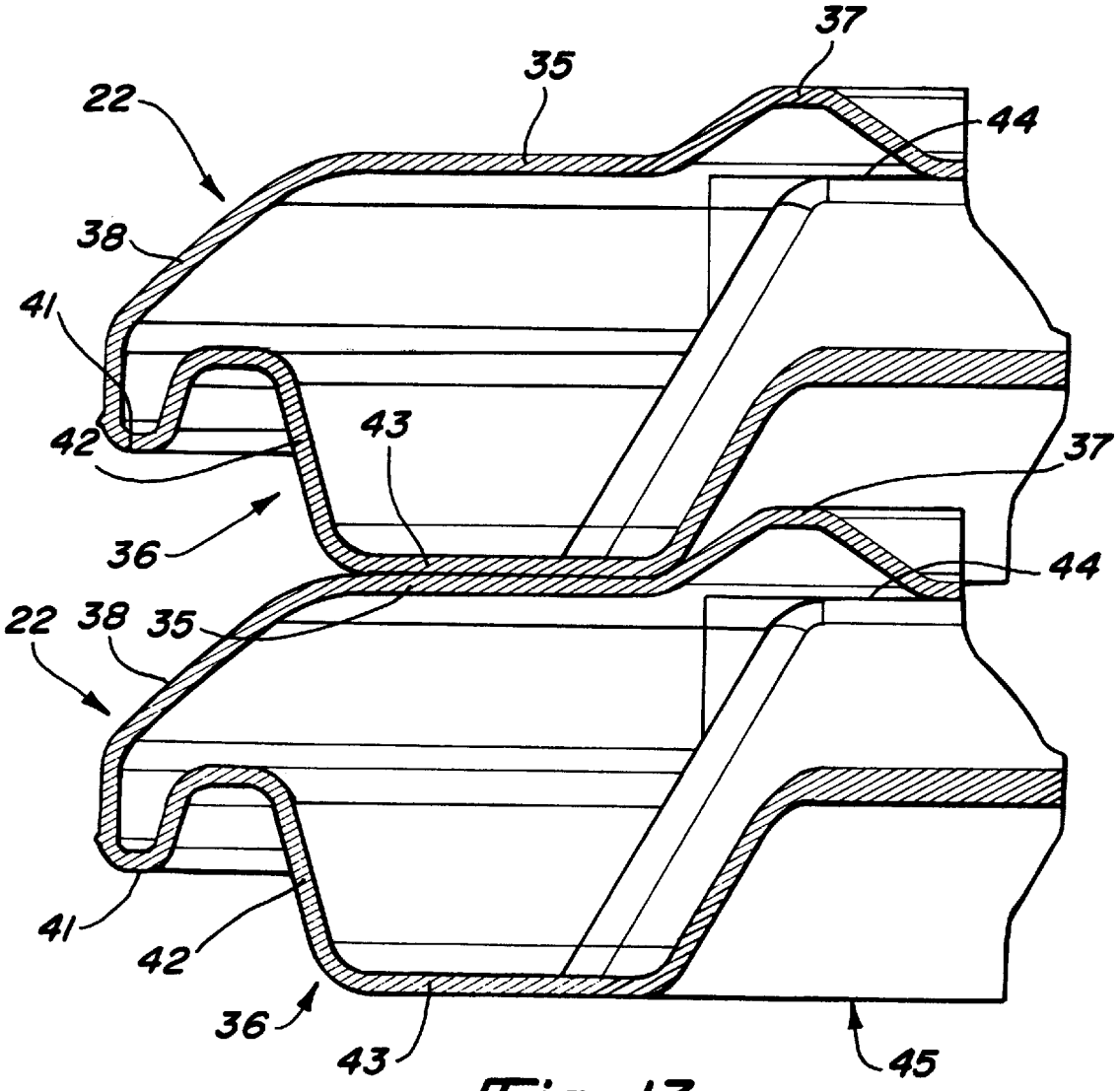
FIG. 13 is a fragmented sectional view showing the manner in which the cover of the present invention can securely stack with a like cover.
Figure 14:
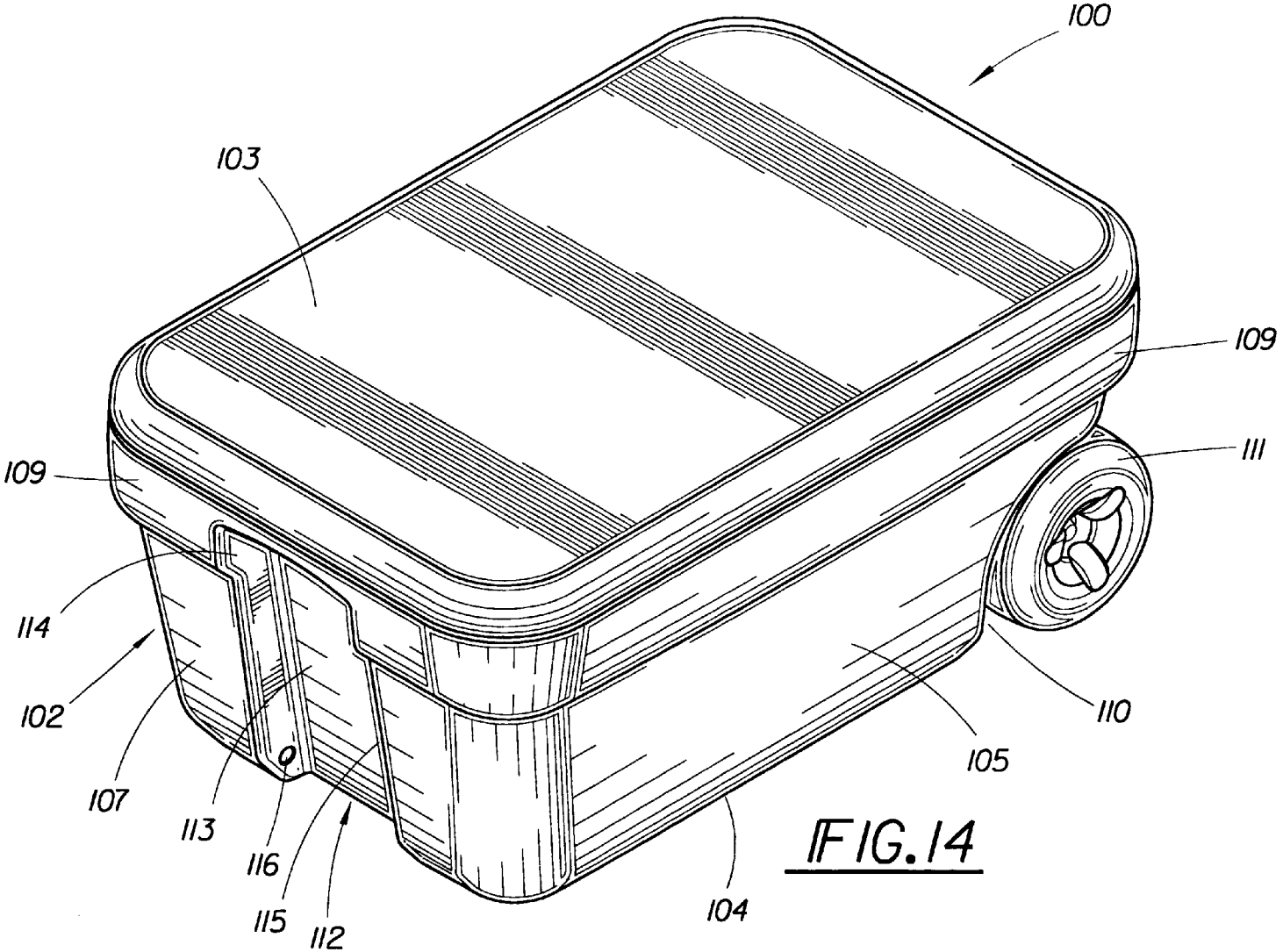
FIG. 14 is a perspective view of an alternative embodiment of the present invention showing a container having wheels on one end thereof and a recess for a handle assembly in the other end thereof.
Figure 15:
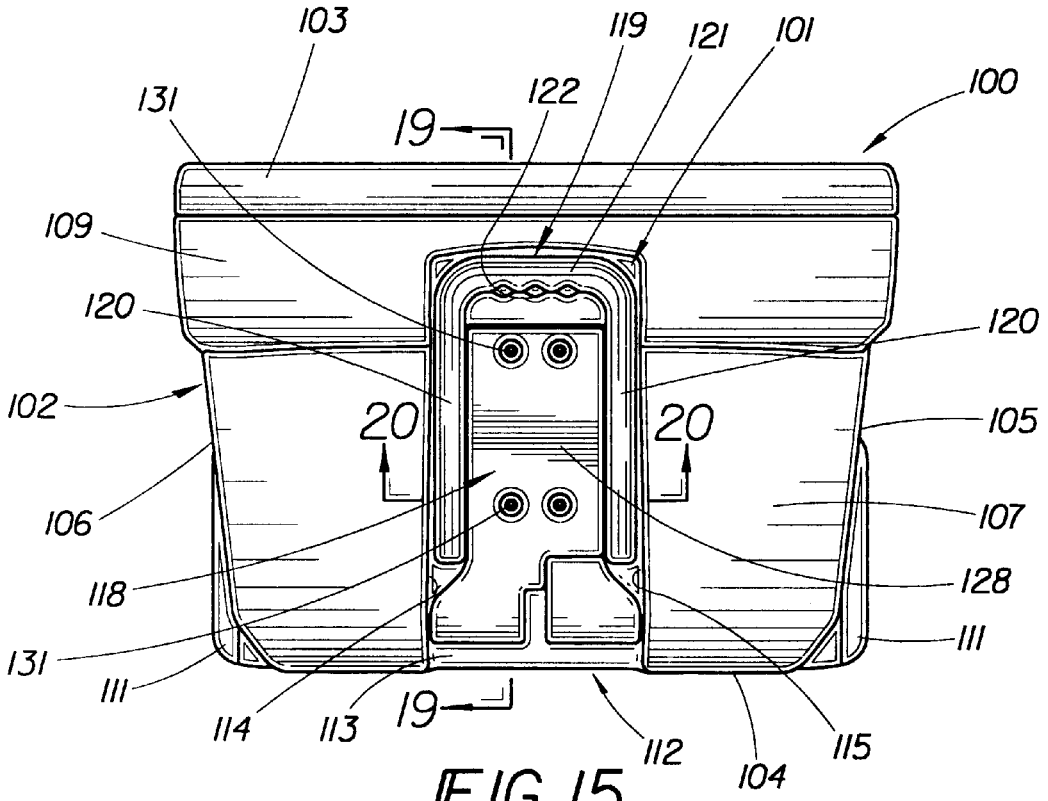
FIG. 15 is an end elevational view of the container of FIG. 14 showing the handle assembly in the recess.

Lower surface 36 joins skirt 38 as a lip 41 which is positioned adjacent to base portion ledge 32 when cover 22 is in the closed position. Lower surface 36 then loops downwardly, as at 42, to a peripheral platform surface 43. As shown in FIG. 13, when two like covers 22 are stacked on one another, platform surface 43 of one cover 22 is received around the track 37 of the cover 22 below and thus the covers cannot easily shift laterally of each other. Inwardly from platform 43, lower surface 36 is provided with a plurality of alternating higher ribs 44 and lower ribs 45 to provide strength to cover 22.

Figure 3:
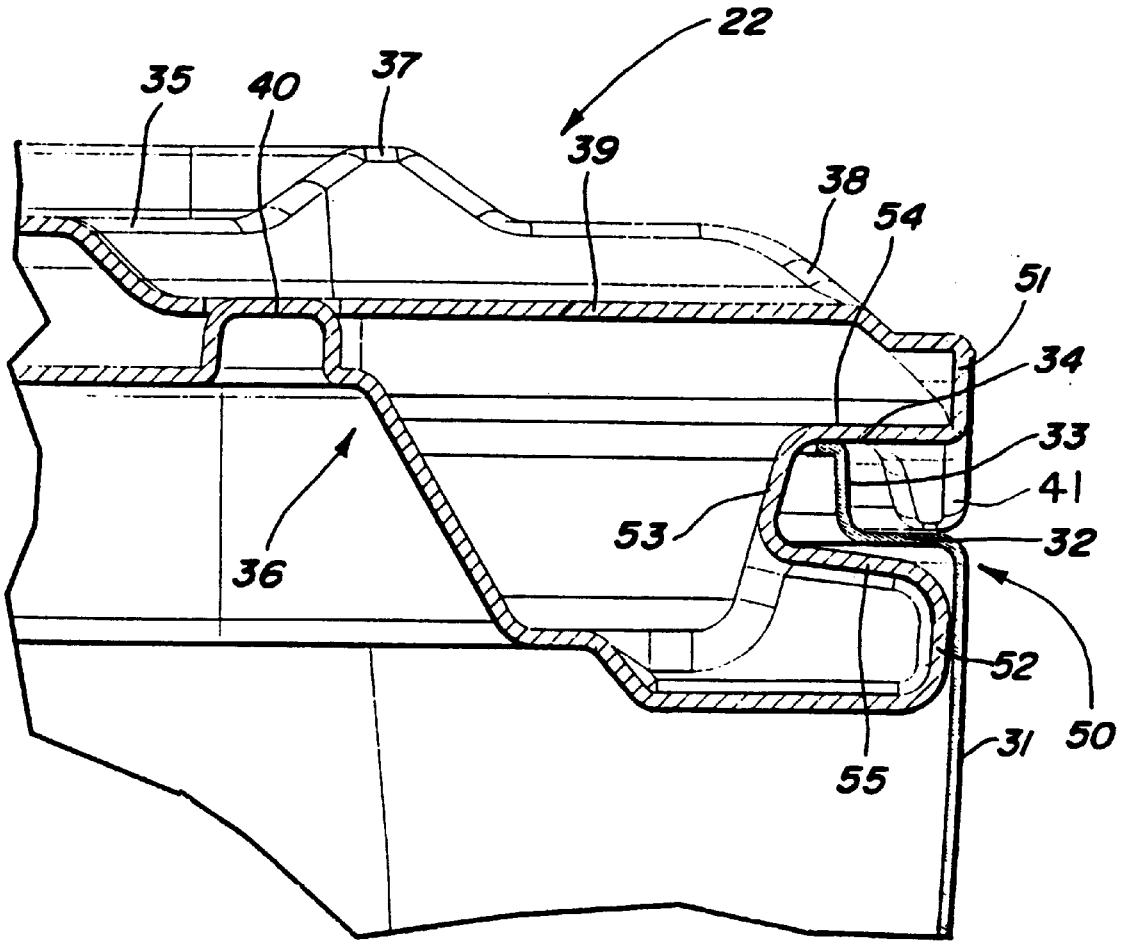
FIG. 3 is a fragmented sectional view taken substantially along line 3—3 of FIG. 2 and showing the cover attached to the base in a hinge-like connection.
Figure 4:
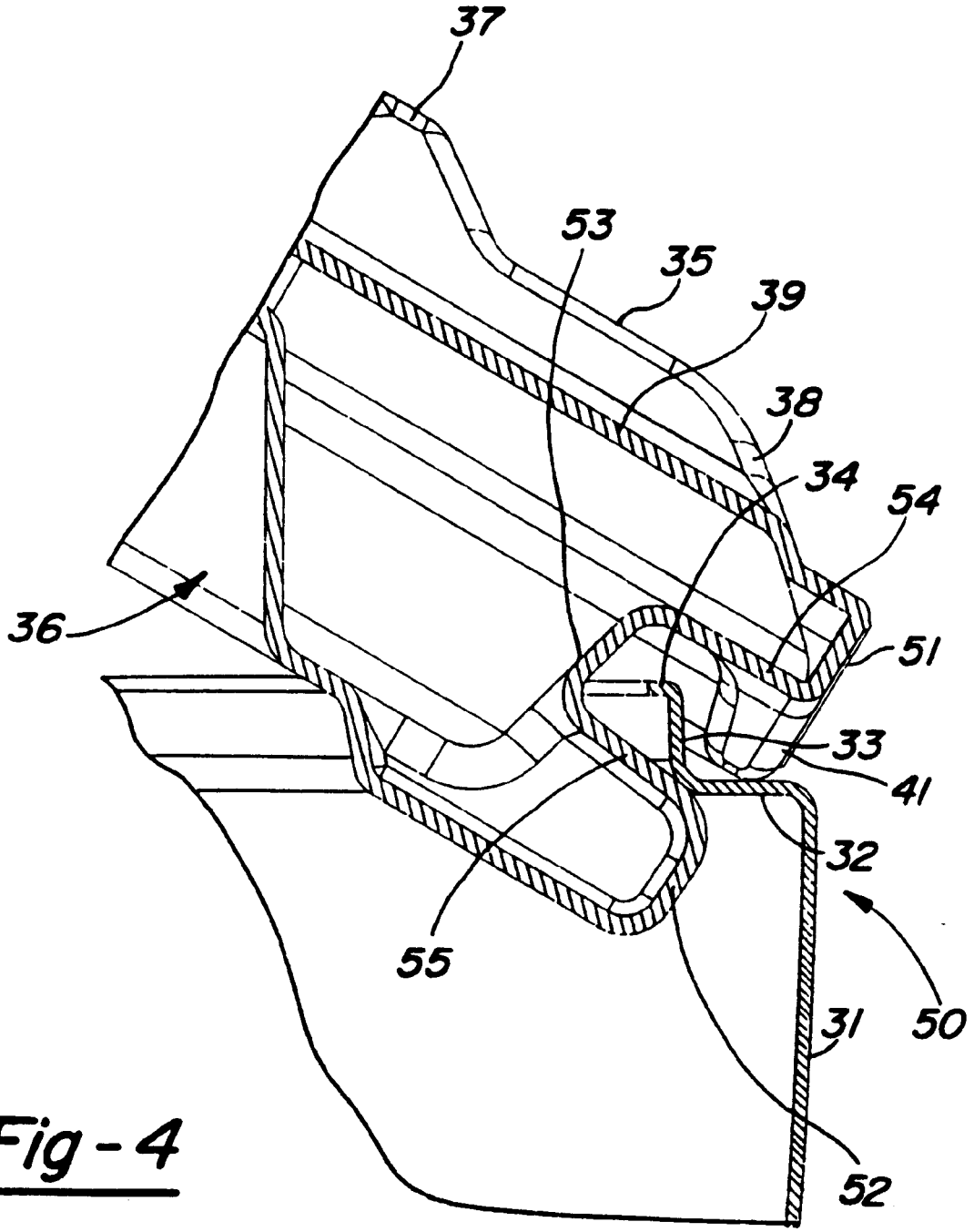
FIG. 4 is a view similar to FIG. 3 but showing the cover and base in a different orientation at the point where the cover can be detached from the base.
Figure 5:
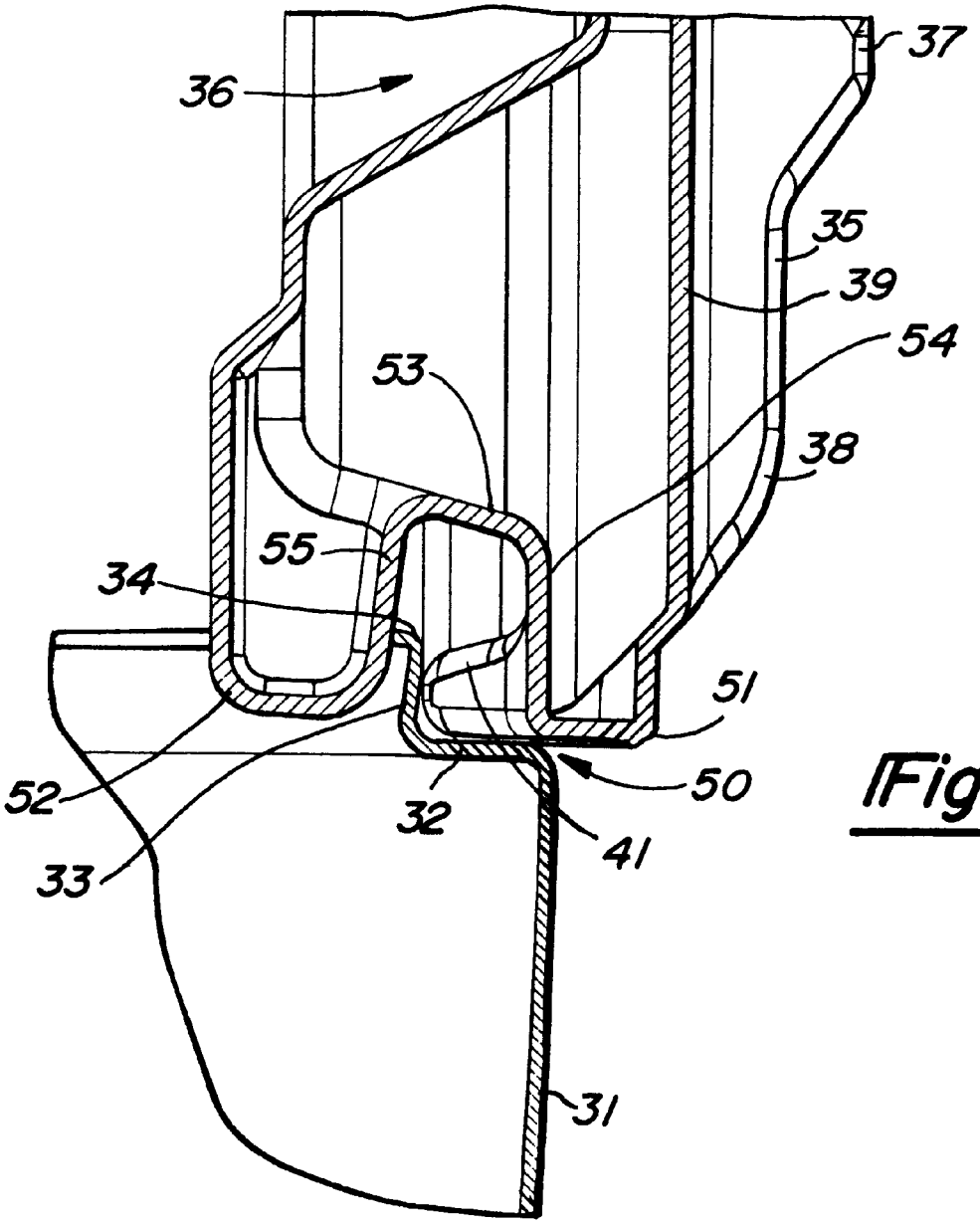
FIG. 5 is a view similar to FIGS. 3 and 4 but showing the cover and base in a position following FIG. 4 and a position at which the cover would automatically detach from the base.

As shown in FIGS. 3–5, one edge of cover 22 is connected to base portion 21 by hinge assemblies generally indicated by the numeral 50. As shown in FIG. 2, two hinge assemblies 50 are provided for container 20, but any number could be provided depending on the size of container 20, the hinge strength needed, and the like without departing from the concepts of the present invention. Each hinge assembly 50 is preferably identical and therefore only one needs to be described in detail.

At the area of each hinge assembly 50, cover lip 41 and its associated elements are interrupted and, instead, an upper hook member 51 is formed at the back edge of skirt 38 at the area of cover surface 39. A lower hook member 52 is formed below, and spaced from, hook member 51. A U-shaped socket 53 is thereby formed between hook members 51 and 52 with the upper branch 54 thereof being the lower portion of hook member 51 and the lower branch 55 thereof being the upper portion of hook member 52.

The manner in which the cover 22 may be placed on, and taken off, base portion 21 is shown in FIG. 4. By holding cover 22 at approximately thirty degrees from horizontal, ledge 32, lip 33 and rim flange 34 may be received within socket 53. By then rotating cover 22 counterclockwise as viewed in FIG. 4, back to horizontal, the junction of ledge 32 and lip 33 rides along branch 55 of socket 53 until the horizontal, FIG. 3, position is reached. In this position, cover 22 cannot be removed from base 21 because, if one were to grasp hook member 51 and try to lift cover 22 vertically, ledge 32 would interfere with branch 55 and prohibit its movement. A sliding movement, directly laterally to the left as viewed in FIG. 3, is prohibited by the interference of base portion lip 33 and cover lip 41 at the rear of container 20, as shown in FIG. 3, and by the interference of base portion rim flange 34 and cover surface 42 at the front of container 20. Moreover, cover 22 can be attached to the front of base container portion 21, and its lateral movement thereby prohibited, by a latch mechanism located on the opposed edge of cover 22 and generally indicated by the numeral 60 to be hereinafter described.

When latch mechanism 60 is released, cover 22 may be rotated on hinge assembly 50 and, if desired, when reaching the thirty degree, FIG. 4, position, it may be totally removed from base portion 21. On the other hand, socket 53 can continue to rotate over ledge 32 and lip 33 even to the essentially vertical position shown in FIG. 5. It should be noted that in that position, branch 55 of socket 53 is beginning to bear on rim flange 34 to begin to flex lip 33. Any further significant rotation beyond the FIG. 5 position will cause branch 55 to snap over lip 33, and cover 22 will thereby automatically be removed from base portion 21. Thus, if desired, after rotation of about thirty degrees, cover 22 may either be removed by pulling the same or by continuing the rotation until it automatically snaps off.

Figure 6:
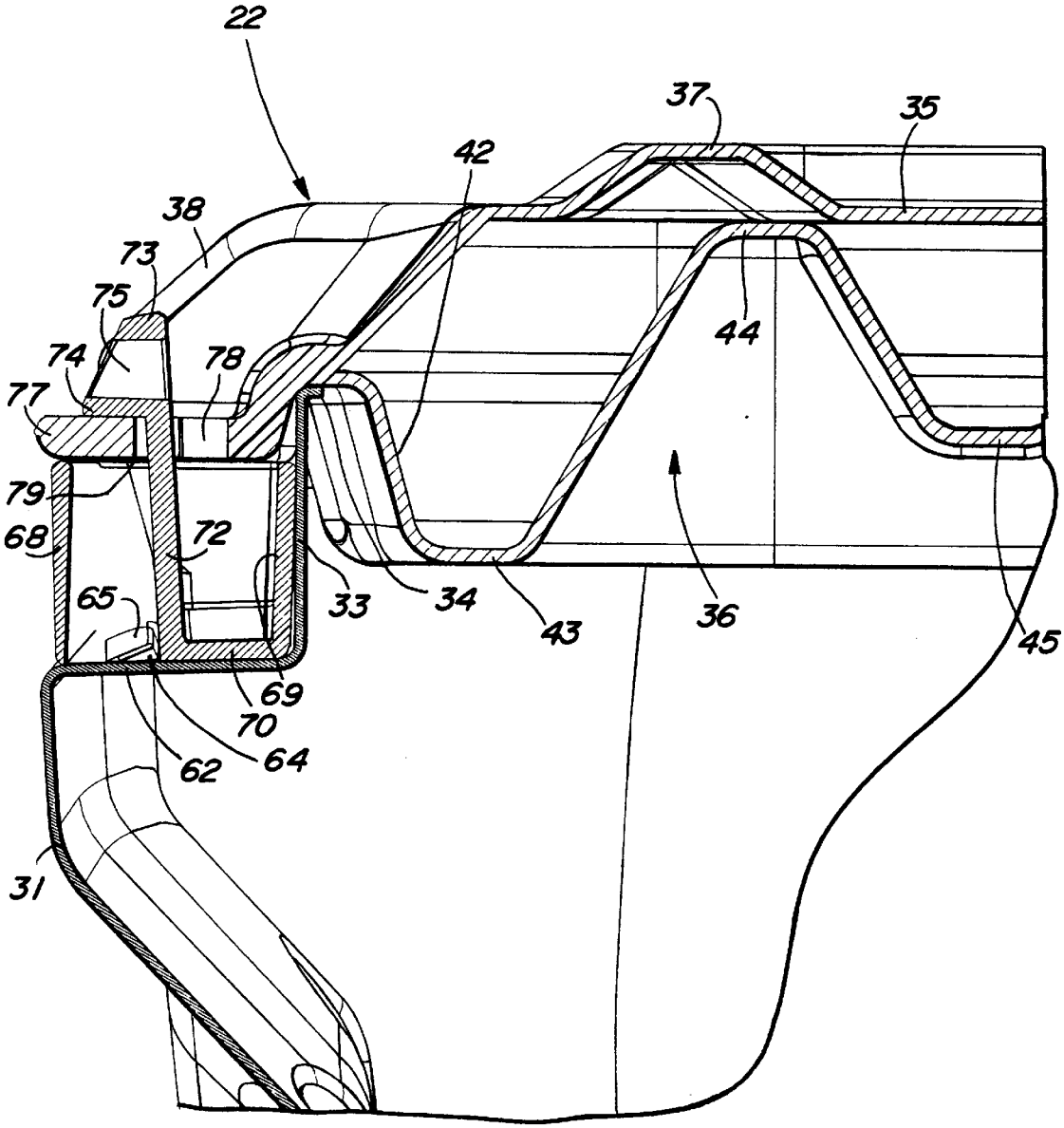
FIG. 6 is a fragmented sectional view taken substantially along line 6—6 of FIG. 1 and showing the latch mechanism of the present invention.
Figure 7:
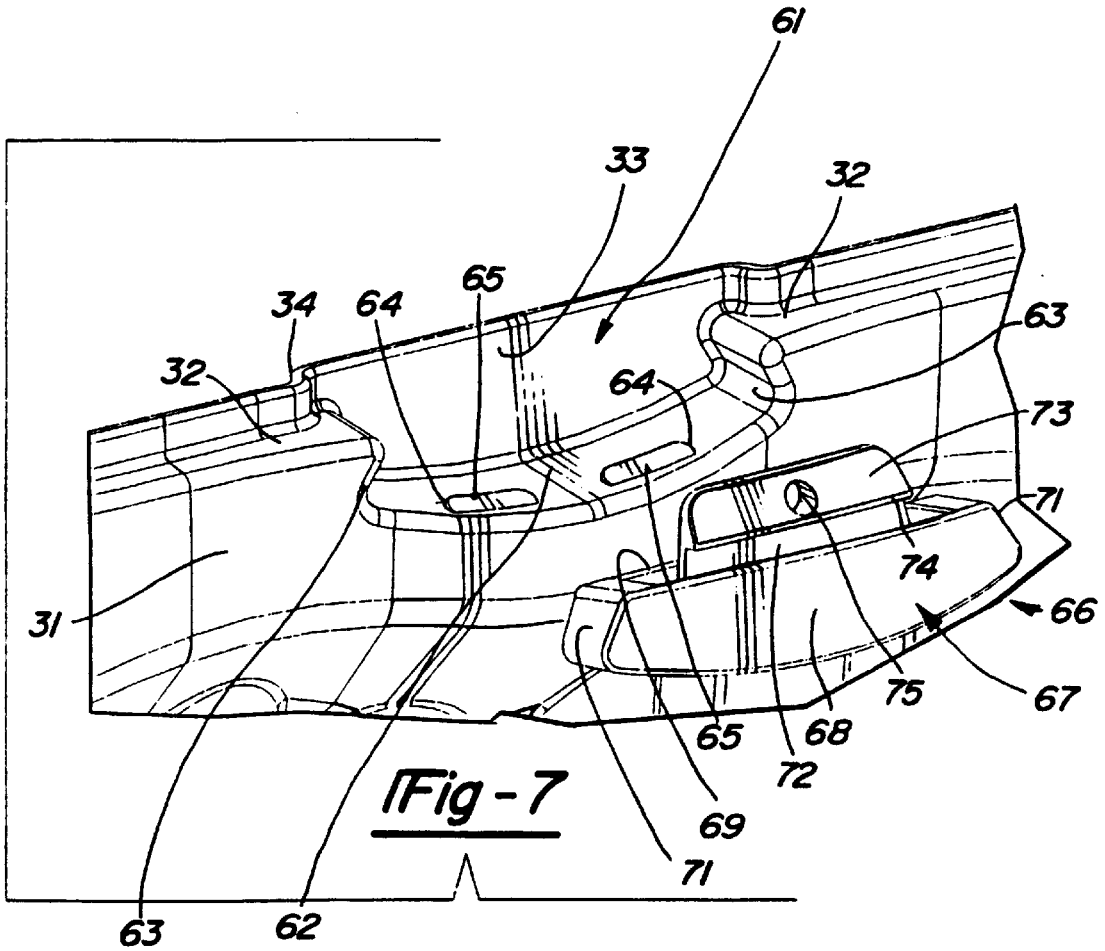
FIG. 7 is a fragmented, exploded perspective view showing a portion of the latch mechanism as it is being assembled.

Latch mechanism 60 is best shown in FIGS. 6 and 7. As shown in FIG. 7, a pocket, generally indicated by the numeral 61, is formed in collar 31 of base portion 21. Pocket 61 interrupts ledge 32 and utilizes lip 33 as its back wall. Pocket 61 is open at the top and has a somewhat arcuate bottom surface 62 and inwardly-directed side walls 63. Lock lugs 64, having an inclined cam surface 65, are provided on bottom surface 62 to assist in positioning a latch block, generally indicated by the numeral 66, in pocket 61.

Latch block 66 includes a body member 67 having the same shape and outer profile as pocket 61. That is, body member 67 has a front wall 68 complimenting collar 31, a back wall 69 parallel to lip 33, a somewhat arcuate bottom surface 70 corresponding to surface 62 of pocket 61, and inwardly-directed side walls 71 corresponding to side walls 63 of pocket 61. As shown in FIG. 6, bottom surface 70 does not extend all the way from back wall 69 to front wall 68. Rather, front wall 68 is connected only to side walls 71 and bottom surface 70 terminates at an upstanding flexible latch tongue 72 which is thereby spaced between front wall 68 and back wall 69. Latch tongue 72 also extends above and outward of body member 67 and has an inclined camming surface 73 formed at the top thereof. Surface 73 terminates at its lower end as a lock barb 74. An aperture 75 extends horizontally through surface 73, above barb 74, to receive a padlock, if desired, as will be hereinafter discussed.

During assembly, latch block 66 is positioned in pocket 61 by pushing it toward lip 33 and thereby sliding its bottom surface on inclined surface 65 of lock lugs 64 until it snaps over lugs 64. At such time, as shown in FIG. 6, lugs 64 are positioned between front wall 68 of body member 67 and the bottom of latch tongue 72 to thereby engage latch tongue 72 and body member 67 to firmly hold latch block 66 in pocket 61.

As shown in FIG. 1, a corresponding pocket or recess 76 is formed in an interruption at cover skirt 38, recess 76 being positioned in cover 22 such that it aligns with pocket 61 when cover 22 is placed on base portion 21. Thus, at recess 76, cover lip 41 is interrupted and a generally horizontal tab 77 is formed across recess 76. Tab 77 has an elongate aperture 78 formed therethrough. As cover 22 is being closed on base portion 21 and latch mechanism 60 (cover 22 being rotated from the FIG. 4 to the FIG. 3 position), the edge 79 of tab 77 at aperture 78 rides on inclined camming surface 73 of flexible tongue 72. As such, tongue 72 is flexed or bent to the right (clockwise) as viewed in FIG. 6, until barb 74 clears aperture 78 at which time tongue 72 snaps back to the FIG. 6 position with barb 74 engaging tab 77. With the latch mechanism 60 in the FIG. 6 condition and the hinge member 50 thereby being in the FIG. 3 position, cover 22 cannot be moved vertically or laterally unless tongue 72 is manually engaged and pushed backwards, to the right as viewed in FIG. 6, so that cover 22 can be lifted and barb 74 will pass through tab aperture 78. If desired, when in the latched, FIG. 6, position, a padlock may be positioned through aperture 75 in barb 74 to secure the contents of container 20.

Container 20, with or without its cover 22, may be conveniently lifted and carried by means of generally identical side handle assemblies generally indicated by the numeral 80 and shown in the most detail in FIGS. 8–11. But first, with reference to FIGS. 1 and 2, it should be noted that each side handle assembly is positioned in a recess 81 in collar 31, each recess 81 being located above each recess 30 in end walls 26. Each recess 81 is open at the bottom, adjacent to side wall recess 30, and includes a back wall 82 and side walls 83 and 84.

Figure 8:
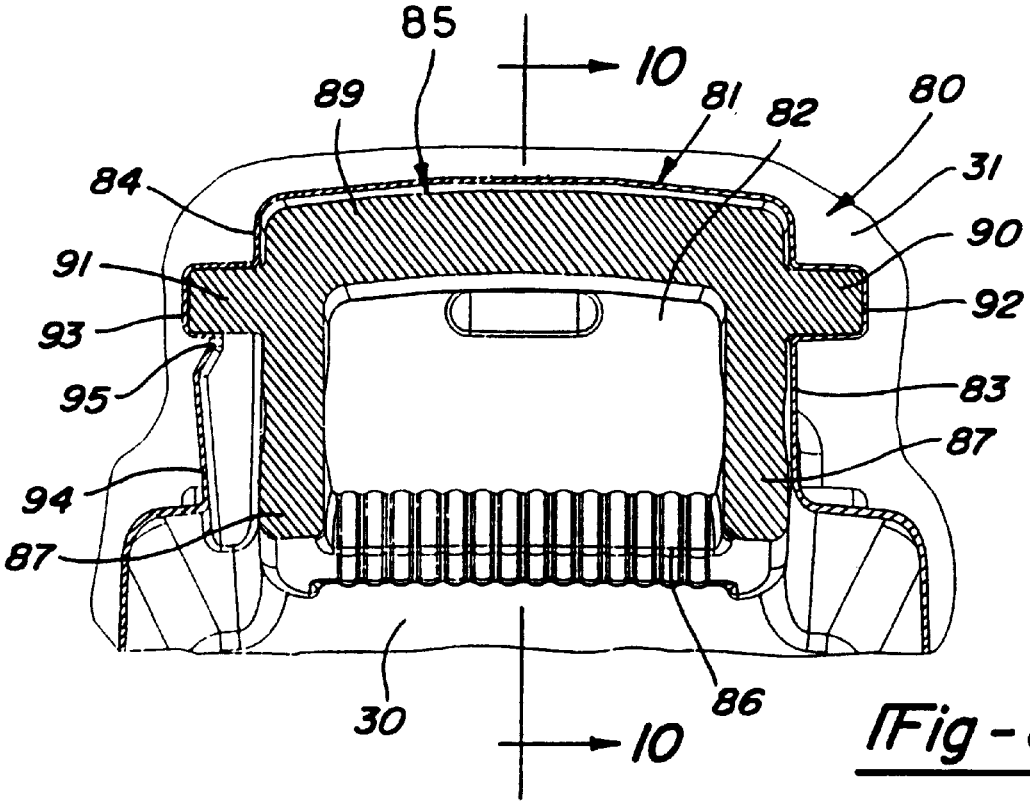
FIG. 8 is a fragmented elevation view of a side handle of the storage container of FIG. 1.
Figure 10:
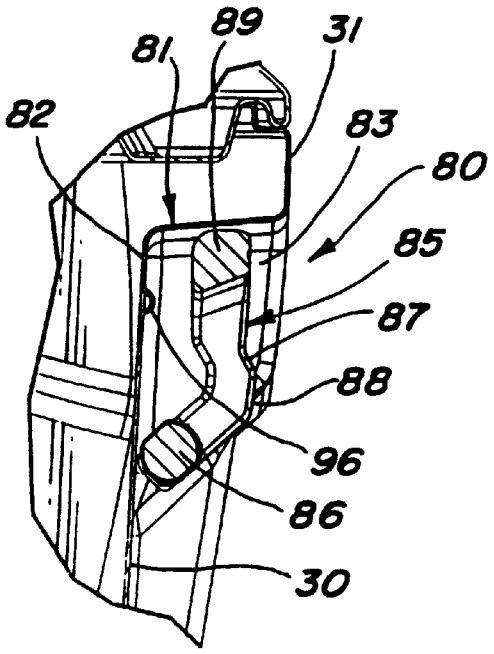
FIG. 10 is a fragmented sectional view taken substantially along line 10—10 of FIG. 8.

As best shown in FIG. 8, each side handle assembly 80 includes a handle member, generally indicated by the numeral 85, which includes a textured grip portion 86 having parallel arms 87 extending from the ends thereof. Arms 87 are dog-legged, as at 88 (FIG. 10), generally medially thereof, and are interconnected at their other end by a stop bar 89 which is thus positioned spaced from, but generally parallel to, grip position 86. A pair of pivot pins 90, 91 extend outwardly from arms 87 near the stop bar ends thereof but in the opposite direction from stop bar 89.

Figure 9:
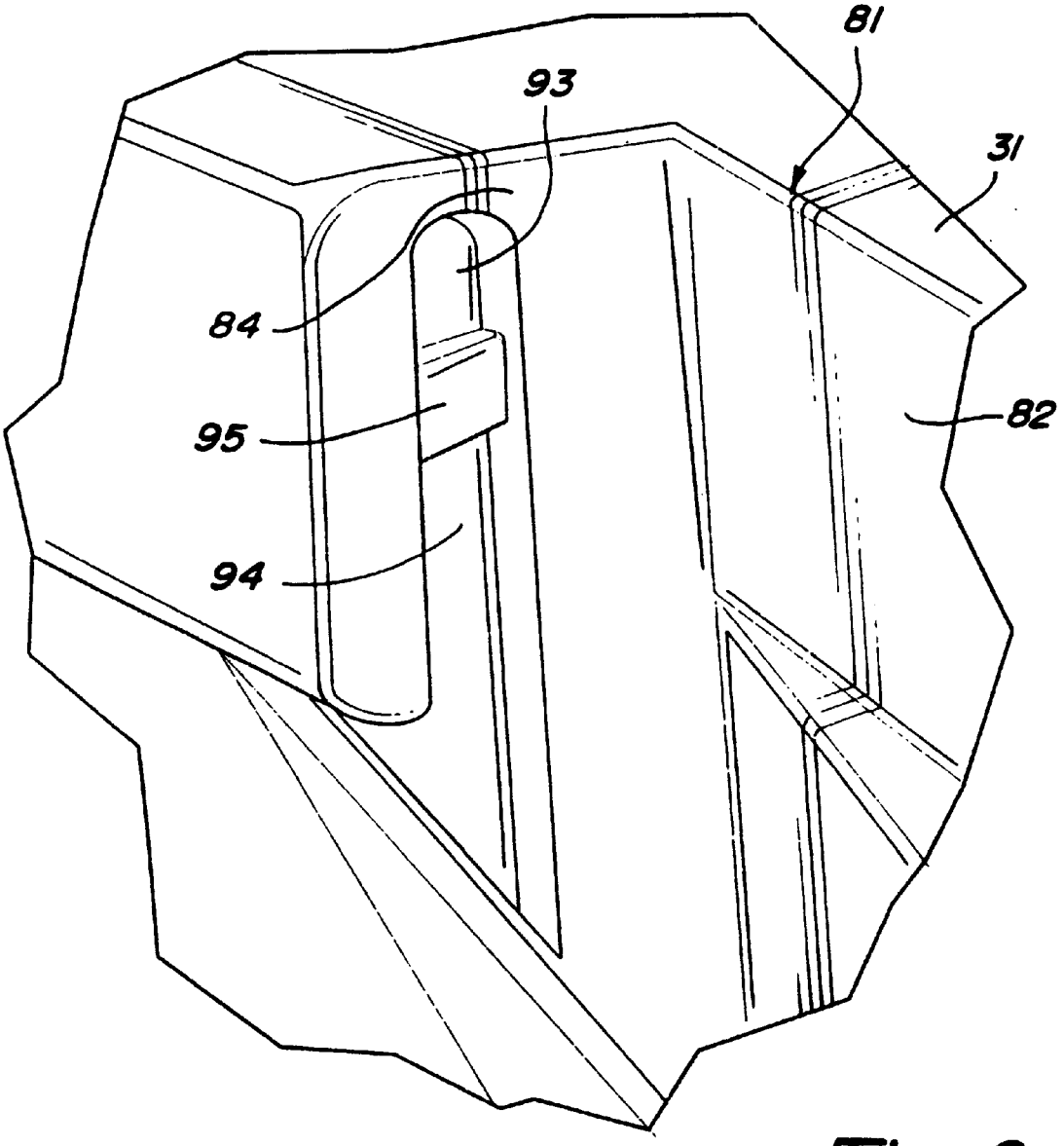
FIG. 9 is a fragmented perspective view showing a portion of the area in which the side handles shown in FIG. 8 are installed.
Figure 11:
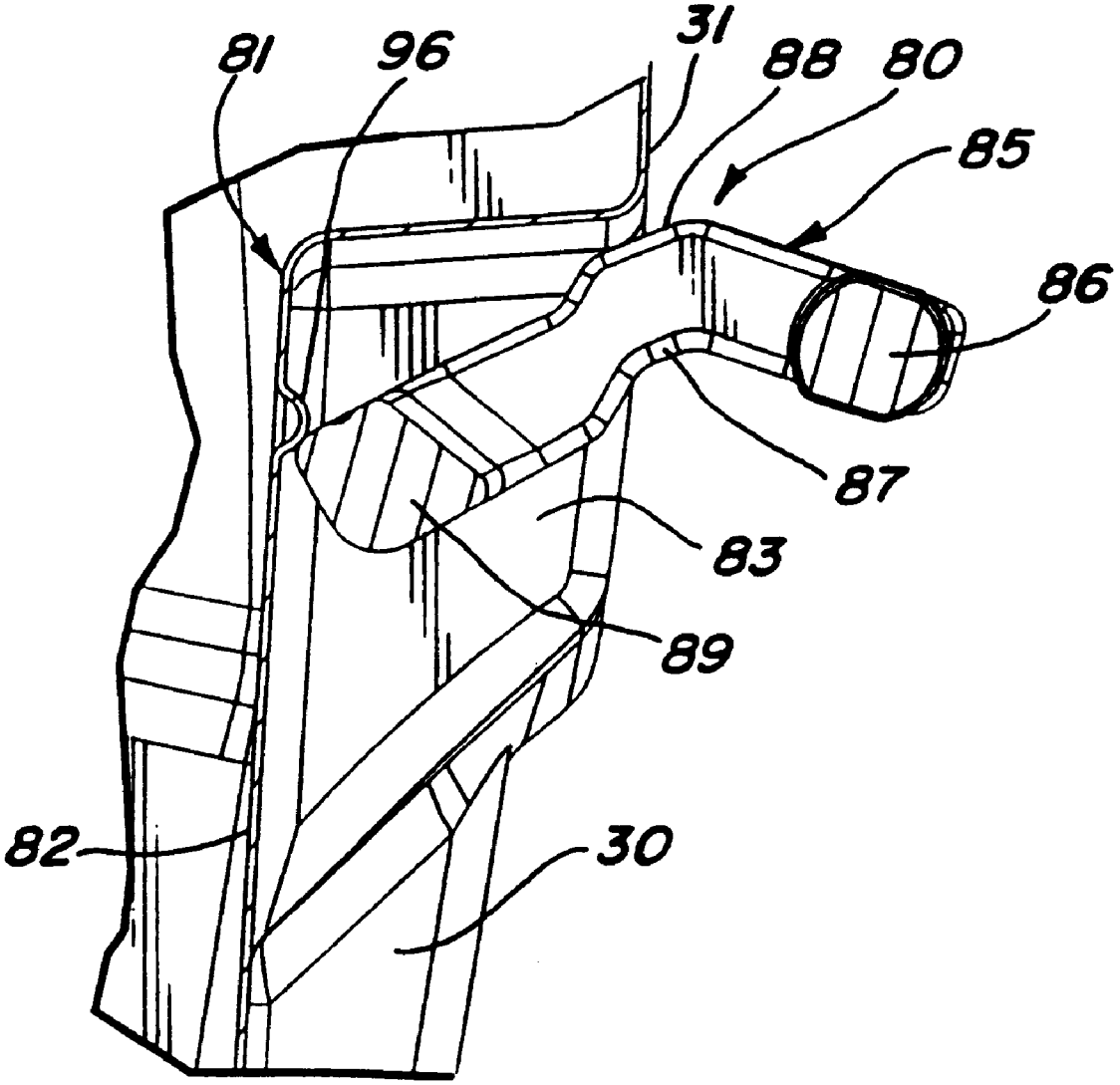
FIG. 11 is a view similar to FIG. 10 but showing the handle in its operative position.

Pivot pins 90, 91 are received in recesses 92, 93, respectively, formed in side walls 83, 84, respectively, of handle recess 81. As shown in FIGS. 8 and 9, handle member 85 can be easily installed in recess 81 when base portion 21 is still warm from the molding process by first positioning pivot pin 90 in recess 92. Then pin 91 is positioned at the lower portion of a recessed lead-in ramp surface 94 formed in recess side wall 84. A nub 95 is formed near the top of ramp surface 94 and just underneath recess 93. As pin 91 is pushed up on ramp surface 94, side wall 84 and its associated members, including nub 95, because they are warm and still somewhat soft, will flex enough to allow pivot pin 91 to snap over nub 95 and into recess 93 thereby quickly and easily installing handle member 85 in recess 81.

Handle members 85 are shown in their recessed position in FIGS. 1, 2, 8 and 10. In that position, if desired, it has been found that container 20 can be carried by merely grasping the bottom of the stop bar 89 and lifting straight up. However, the preferred manner to utilize handle members 85 to carry container 20 is to grasp grip portion 86 and pull it outward, thereby rotating handle member 85 on its pivot pins 90 and 91. Once handle member 85 is rotated to the FIG. 11 position, where handle stop bar 89 has been rotated past, and is positioned under, a retaining lug 96 formed on handle recess back wall 82, handle member 85 will stay in the FIG. 11 position. That is, handle 85 will not drop back to the FIG. 10 position, by gravity, because stop bar 89 is engaging lug 96. In this position, with the grip portions 86 of handle member 85 positioned laterally outside of container 20, they may be lifted and dog-legged portion 88 of the handle will engage the bottom of collar 31 at the top of recess 81 so that container 20 can be easily carried. When it is desired to again position handle members 85 in their recesses 81, all that need be done is to push downwardly on grip portions 86 and stop bars 89 will pass over lugs 96 to allow the handle member 85 to return to the normal FIG. 10 position.

Shown in FIGS. 14–20, inclusive, is a container generally indicated by the numeral 100 having an alternative embodiment of a side handle assembly generally indicated by the numeral 101. Except for side handle assembly 101, container 100 can be identical to container 20 but could also take on any configuration without departing from the concept of this aspect of the present invention. Thus, container 100 has been shown as rather plain and unadorned and includes a base portion generally indicated by the numeral 102 and a cover 103.

Base portion 102 includes a bottom surface 104 having a generally vertical front wall 105 and opposed rear wall 106 extending upwardly therefrom. Opposed side walls 107 and 108 also extend generally vertically upwardly from bottom surface 104. Side walls 107, 108 join front wall 105 and rear wall 106 to form the base container 102 with an open top which is further defined by an enlarged upper collar 109 extending around the entire periphery thereof. Cover 103 may selectively close or open the top and although not shown, it is to be understood that cover 103 may be hingedly attached to rear wall 106 by any suitable means, which could be hinge assembly 50, and may be latched to front wall 105 by any suitable means, which could be latch mechanism 60.

Figure 16:
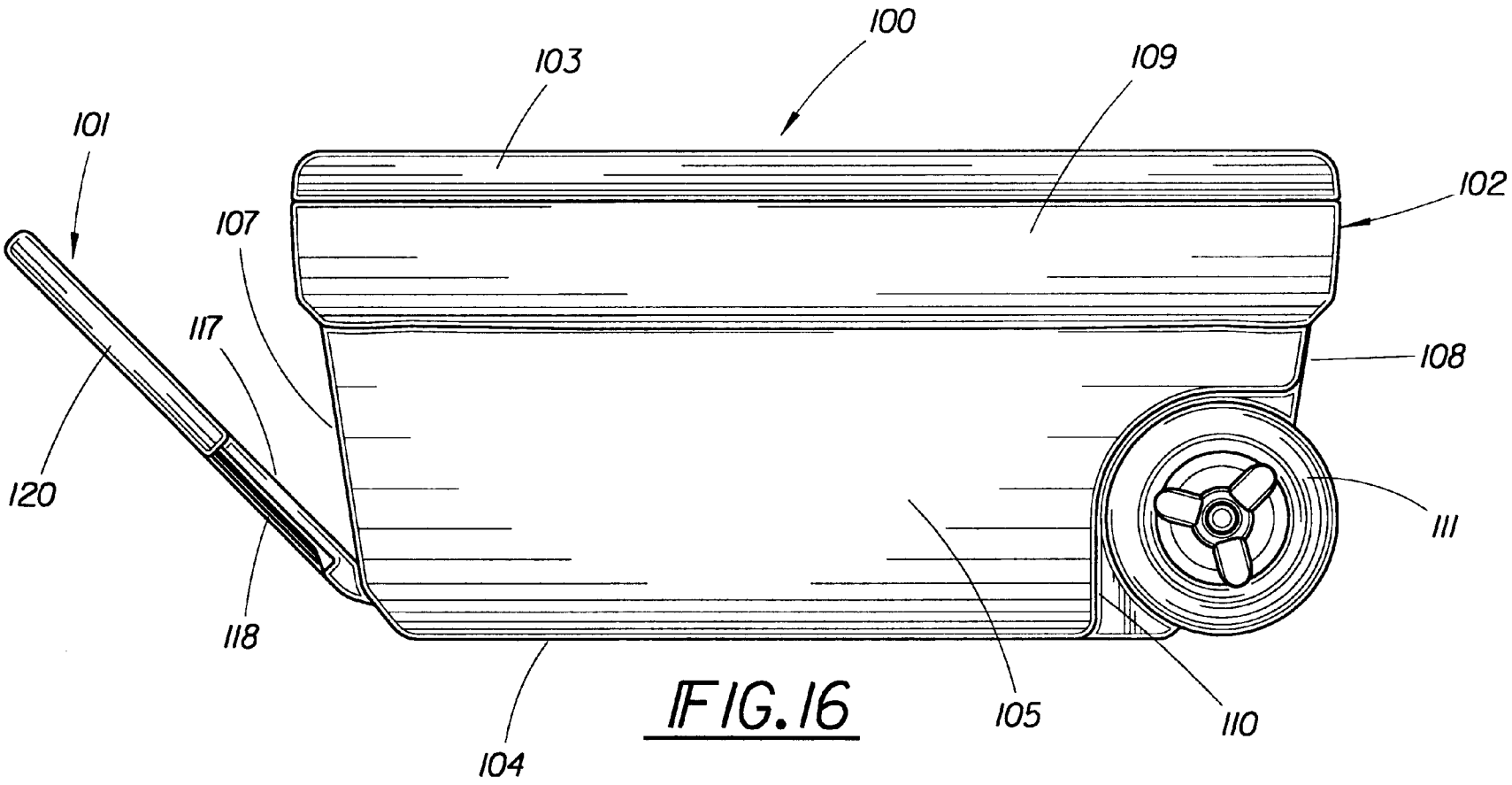
FIG. 16 is a side elevational view of the container of FIG. 14 showing the handle assembly pivoted out of the recess and the handle arm extended.

Although a handle assembly 101 may be provided for each side wall 107, 108, handle assembly 101 is particularly suited for a wheeled container and thus wall 108 of container 100, as shown, is provided with wheel wells 110 to receive wheels 111. As best shown in FIG. 16, for stability purposes, wheels 111 are normally positioned slightly above the plane of bottom surface 104 and are therefore not operable to assist in the movement of container 100 until manipulation of handle assembly 101 permits wheels 111 to touch the ground as will hereinafter be described.

Where only one handle assembly 101 is provided, side wall 107 opposite to wheels 111 is provided with a recess 112 which is generally open at the bottom and which extends into collar 109, it being understood that for a container 100 without wheels 111, side wall 108 may also have a recess identical to recess 112 for receiving a handle assembly identical to handle assembly 101. Recess 112 includes a back wall 113 and opposed side walls 114, 115. Each wall 114, 115 is provided with a pivot aperture 116 formed in and near the bottom thereof.

Handle assembly 101 can best be described with reference to FIGS. 17–20, inclusive. As shown, handle assembly 101 includes three primary components, a back plate generally indicated by the numeral 117, a front plate generally indicate by the numeral 118, and a handle member generally indicated by the numeral 119 and having portions thereof telescopically sandwiched between plates 117 and 118.

Handle member 119 is generally U-shaped in configuration having opposed spaced side arms 120 with a grip member 121 connecting one end of arms 120. As shown, the underside of grip member 121 may be formed as an undulating surface 122 to provide gripping comfort.

Figure 18:
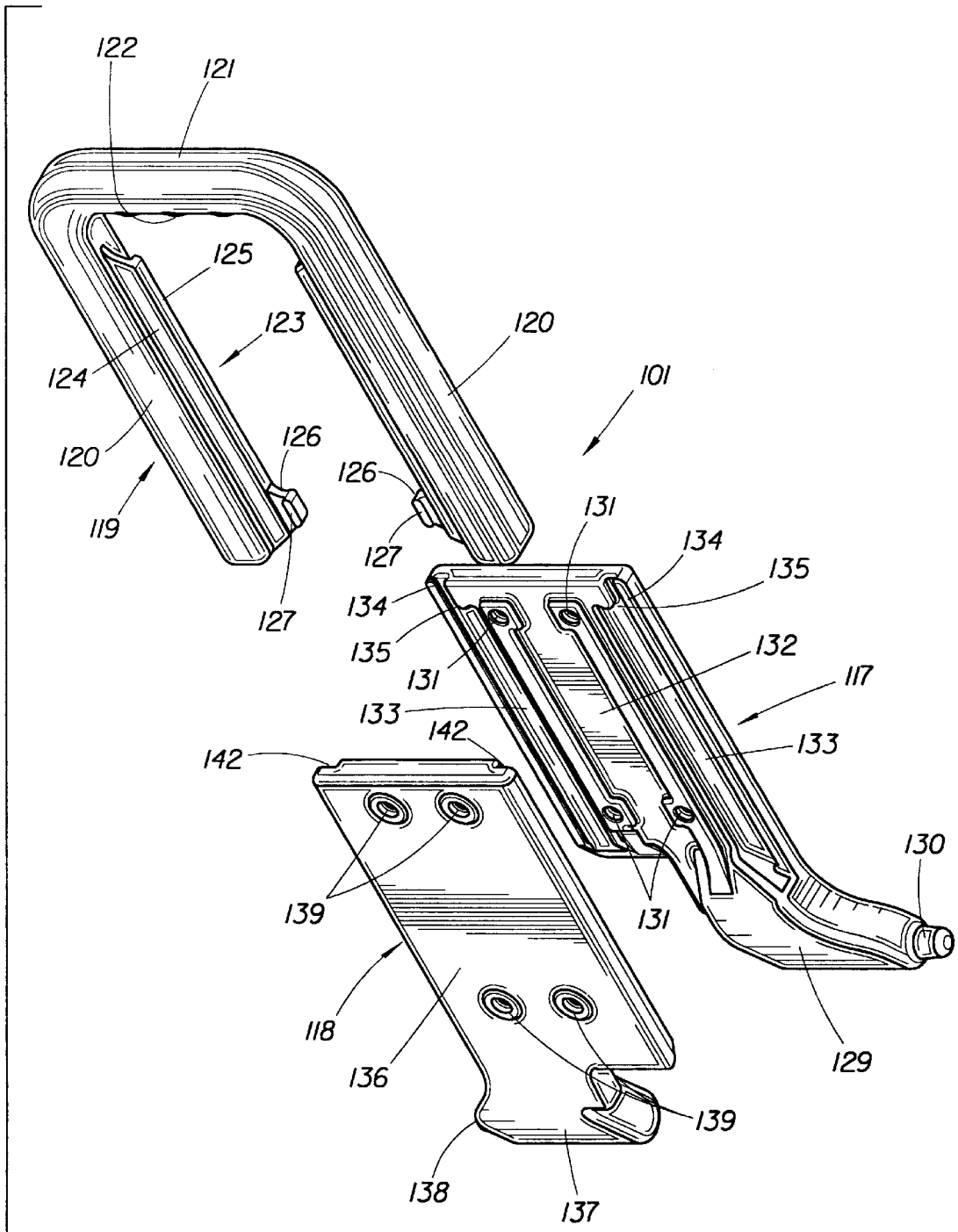
FIG. 18 is an exploded perspective view similar to FIG. 17 but looking in the opposite direction.
Figure 19:
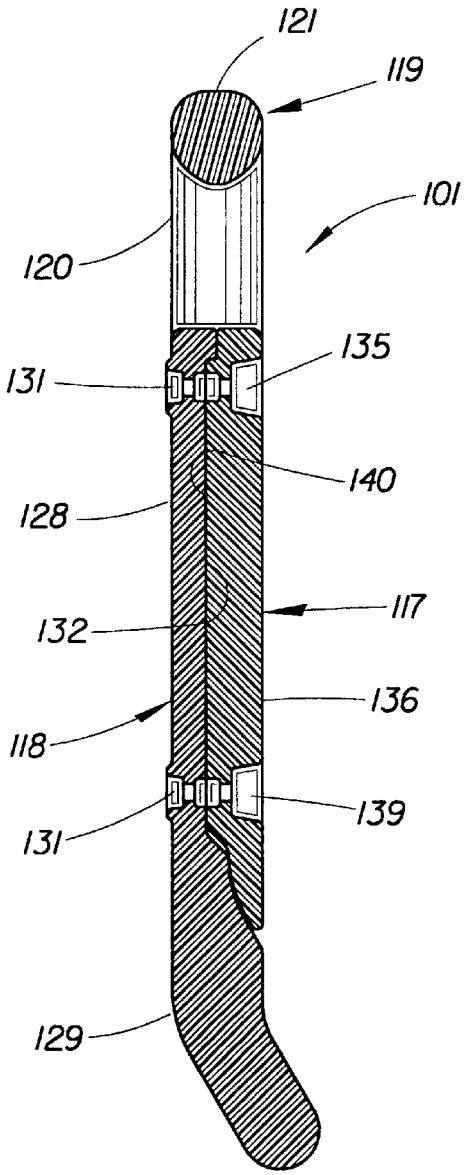
FIG. 19 is a sectional view take n substantially along line 19—19 of FIG. 15.
Figure 20:
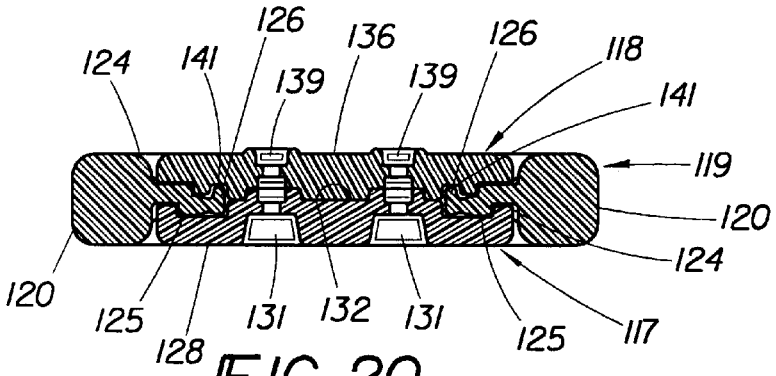
FIG. 20 is a sectional view taken substantially along line 20—20 of FIG. 15.

A rail, generally indicated by the numeral 123, extends inwardly from each arm 120. Each rail 123 includes a surface 124 extending generally laterally inwardly from arm 120 and having a rib 125 on the inner end thereof extending generally laterally of surface 124 and parallel to arm 120. The bottoms of rails 123 are provided with inwardly extending hooks 126, the back of which have a vertical slot 127 therein (FIG. 18).

Back plate 117 includes a generally flat body portion 128 having an offset arm 129 extending downwardly and inwardly from the bottom thereof. A pivot pin 130 extends laterally outwardly from a position near the bottom of offset arm 129. Body portion 128 is provided with a plurality (four shown) of through bores 131. As best shown in FIG. 18, the inside surface of body portion 128 includes a central, flat bearing surface 132 positioned between bores 131 and two generally vertical raceways 133 positioned to the sides of bearing surface 132 and having laterally outer slot tracks 134 therein. An upper shoulder 135 is formed near the top of each raceway 133 and laterally inwardly from tracks 134.

Figure 17:
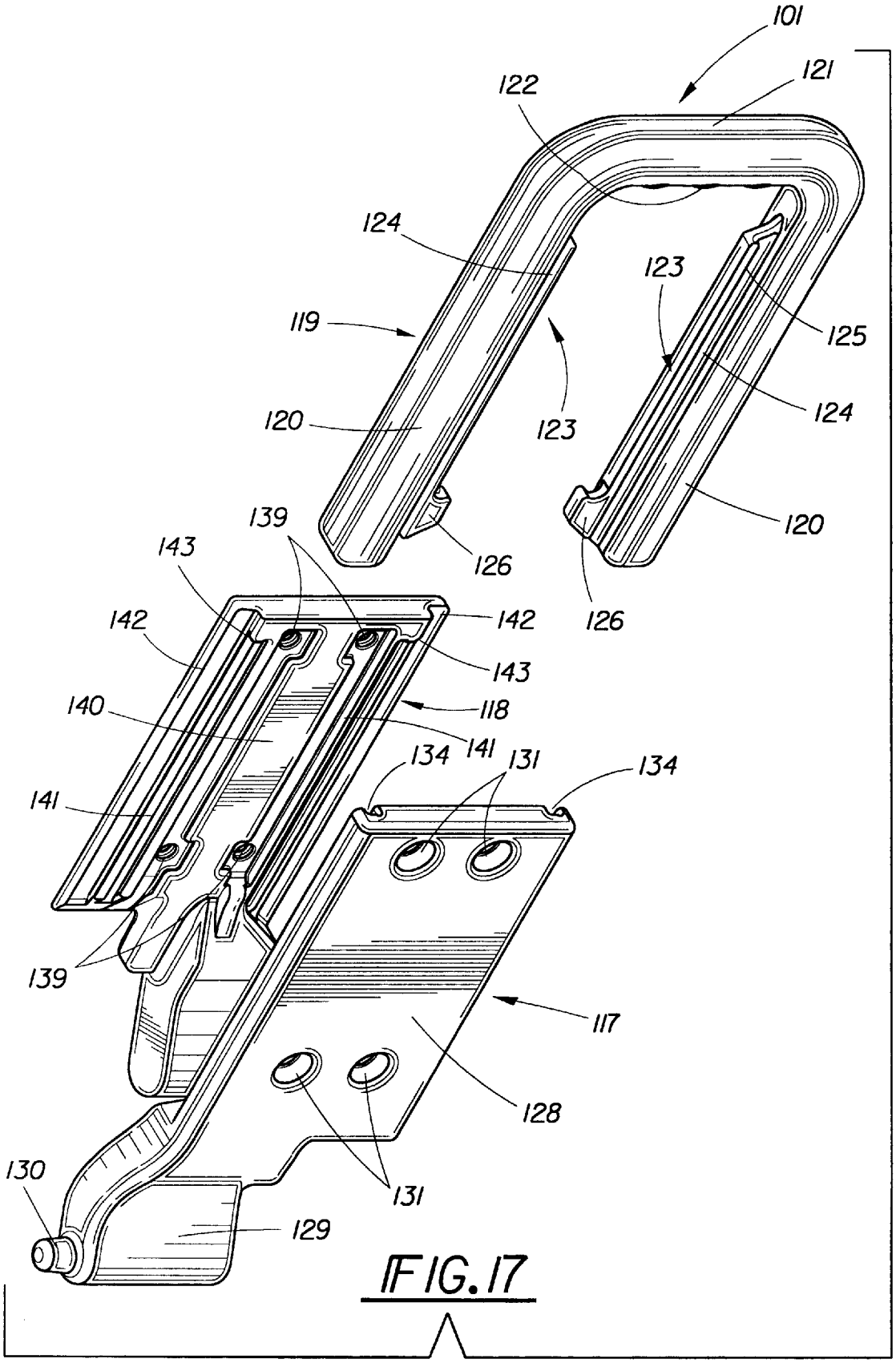
FIG. 17 is an exploded perspective view of the handle assembly shown in FIGS. 14–16.

Front plate 118 is in many respects identical to back plate 117. Thus, front plate 118 also has a generally flat body portion 136 having an offset arm 137 extending downwardly and inwardly from the bottom thereof. A pivot pin 138 (schematically shown) extends laterally outwardly from a position near the bottom of offset arm 129. Body portion 136 is provided with a plurality (four shown) of through bores 139 adapted to be aligned with bores 131 of back plate 117. As best shown in FIG. 17, the inside surface of body portion 136 includes a central flat bearing surface 140 positioned between bores 139 and two generally vertical tracks 141 positioned to the sides of bearing surface 140. Laterally, outwardly of tracks 141 are ledges 142 formed at the lateral edges of front plate body portion 136. An upper shoulder 143 is formed near the top of each track 141 and laterally inwardly of ledges 142.

Handle assembly 101 is assembled and positioned in recess 112 of container 100 by first inserting pivot pin 130 of back plate 117 in its pivot aperture 116. Handle member 119 is then positioned on back plate 117 with its rail 123 positioned so that slots 127 of hooks 126 are engaging track 141 with the rest of rail 123 being positioned adjacent to ledges 142. Then, front plate 118 is placed in position by first inserting pivot pin 138 in its pivot aperture 116. With bearing surfaces 132 and 140 engaging each other, and with bores 131 and 179 aligned, plates 117 and 118 may be riveted or otherwise fastened to each other through bores 131 and 139. As such, rails 123 of handle 119 are telescopically sandwiched between plates 117 and 118 within raceways 133 and ribs 125 of rails 123 are slidably received within slot tracks 134 of back plate 117.

When not in use, handle assembly 101 is readily positioned out of the way within recess 112. To use handle assembly 101, one need only rotate it on pins 130, 138 to the position shown in FIG. 16. Then by pulling handle member 119 relative to plates 117 and 118, rails 123 move vertically relative to plates 117 and 118 until hooks 126 engage mating shoulders 135, 143. Container 100 may then be lifted onto wheels 111 as the weight thereof is supported on the hook/shoulder engagement. It should also be evident that the hook/shoulder engagement maintains handle member 119 between plates 117 and 118 so that is cannot slide out.

In view of the foregoing, it should be appreciated that a storage container constructed in accordance with the concepts of the present invention, as described herein, accomplishes the objects of the present invention and otherwise substantially improves the art.

We claim:

1. A container comprising a base portion having a bottom surface and first and second sets of opposed walls extending upwardly therefrom, a recess formed in at least one wall of one set of opposed walls, opposed pivot apertures formed in said recess, and a handle assembly positionable in said recess, said handle assembly including a first plate having a pivot pin receivable in one of said pivot apertures, a second plate having a pivot pin receivable in the other of said pivot apertures, and a handle member slidably supported between said first and second plates so that after said handle assembly is pivoted out of said recess, said handle member can be moved relative to said first and second plates.

2. A container according to claim 1 wherein said handle member is U-shaped having spaced arms connected at one end by a grip member.

3. A container according to claim 2 wherein said spaced arms include rails slidably engaged between said first and second plates.

4. A container according to claim 1 wherein said first plate has a plurality of bores therethrough and said second plate has a plurality of bores therethrough alignable with said bores of said first plate for fastening said first plate to said second plate.

5. A container according to claim 1 further comprising wheels positioned adjacent to the other wall of said one set of opposed walls.

6. A container according to claim 5 wherein said wheels are positioned slightly above the plane of said bottom surface.

7. A container according to claim 1 wherein said handle member includes spaced arms and a hook carried by each said arm.

8. A container according to claim 7 wherein said first and second plates have shoulder surfaces formed therein, said hooks engaging said surfaces when said handle member is moved to its furthest extent relative to said first and second plates.

9. A container according to claim 1 wherein said handle member includes spaced arms and a rail carried by each arm, at least one of said plates having raceways to receive said rails.

10. A container according to claim 9 further comprising a rib on each rail, one of said plates having slots to receive said ribs.

11. A container according to claim 9 further comprising a hook carried by each said rail, said hooks having a slot therein, one of said plates having tracks to engage said slots.

12. A container according to claim 11 wherein said first and second plates have shoulder surfaces formed therein, said hooks engaging said surfaces when said handle member is moved to its furthest extent relative to said first and second plates.

* * * * *